US007229386B2

(12) United States Patent
Wu et al.

(10) Patent No.: US 7,229,386 B2
(45) Date of Patent: Jun. 12, 2007

(54) OVAL-TRACKED EXERCISE APPARATUS

(76) Inventors: Peter Wu, No.1, Lane 233, Sec.2, Charng Long Rd., Taiping (TW) 411; Leao Wang, No.1, Lane 233, Sec.2, Charng Long Rd., Taiping (TW) 411

( * ) Notice: Subject to any disclaimer, the term of this patent is extended or adjusted under 35 U.S.C. 154(b) by 435 days.

(21) Appl. No.: 10/832,707

(22) Filed: Apr. 28, 2004

(65) Prior Publication Data

US 2005/0245361 A1 Nov. 3, 2005

(51) Int. Cl.
*A63B 21/00* (2006.01)
*A63B 22/12* (2006.01)

(52) U.S. Cl. ..... 482/52; 482/70

(58) Field of Classification Search ..... 482/51, 482/52, 57, 70, 79–80
See application file for complete search history.

(56) References Cited

U.S. PATENT DOCUMENTS 6,030,320 A * 2/2000 Stearns et al. ..... 482/57
6,042,512 A * 3/2000 Eschenbach ..... 485/52
6,217,485 B1 * 4/2001 Maresh ..... 482/52
6,824,503 B2 * 11/2004 Wang et al. ..... 482/60
6,955,632 B2 * 10/2005 Wang et al. ..... 482/52
2005/0209057 A1 * 9/2005 Wang et al. ..... 482/52

* cited by examiner

*Primary Examiner*—Stephen R. Crow

(57) ABSTRACT

An oval-tracked exercise apparatus is provided which includes a main frame having a pair of connecting arms in a hinge joint with a traverse support. The traverse support is coupled with a mechanical system in a pivotal connection with a pair of planks. A resisting rotating mechanism is attached to an opposing end of the respective plank. Besides, an adjusting assembly is provided for adjusting the height of the traverse support. The resisting rotating mechanism formed by a flywheel, a belt wheel or a resistance mechanism includes a continually bent crank and is rotatably mounted on side walls of a base of the resisting rotating mechanism. Accordingly, both handles are synchronically movable with respective planks for simulating a climbing action and an oval exercise track. Moreover, a simulation of a movement on uphill, downhill and flat surfaces can be achieved. Furthermore, a reduction of the distance between both planks is also attainable.

4 Claims, 6 Drawing Sheets

OVAL-TRACKED EXERCISE APPARATUS

BACKGROUND OF THE INVENTION

1. Fields of the Invention

The invention relates to an oval-tracked exercise apparatus, and more particularly, to an apparatus in which both handles is synchronically movable with respective planks for simulating a climbing action and an oval exercise track. Moreover, a simulation of a movement on uphill, downhill and flat surfaces can be achieved as well. Furthermore, a reduction of the distance between both planks is attainable.

2. Description of the Related Art

People work for what they need. Meanwhile, they realize how important their health is. Therefore, they do exercise for keeping their bodies in good condition. The simplest way to exercise is the use of the exercise apparatuses. Among the exercise apparatuses, the oval-tracked exercise apparatus can best simulate the actual walking exercise. U.S. Pat. No. 3,315,898 ("Rehabilitation & Exercise Apparatus") teaches that a motor imparts motion to two treadle bars through a belt-driven toothed plate such that the treadle bars move in an offset position. However, it lacks means for keeping the body in balance. Therefore, the operator easily falls from the exercise apparatus due to the instability of his center of gravity.

Another prior art—U.S. Pat. No. 5,242,343 ("Stationary Exercise Device")—teaches that two rocker arms are pivotably connected to the base. The bottom of each rocker arm and the front end of the treadle bars are joined to each other in a movable state. The other end of the treadle bars is attached to the side of the flywheel. Both of the treadles are alternatingly treaded to simulate the movement of hands and feet in an oval track. Meanwhile, both rocker arms move in alternating way to aid the operator in keeping their bodies in balance.

Since the hands of the operators are synchronically movable with the rocker arms to perform the arched, reciprocating motion, this doesn't correspond to the actual coordinating movement of hands and feet during walking session. Due to the non-ergonomic design, the muscle function could be deteriorated, thereby causing the abnormality of the balance sense.

SUMMARY OF THE INVENTION

It is a primary object of the invention is to provide an oval-tracked exercise apparatus in which both handles is synchronically movable with respective planks for simulating a climbing action and an oval exercise track.

Another object of the invention is to provide an oval-tracked exercise apparatus that allows a simulation of a movement on uphill, downhill and flat surfaces A further object of the invention is to provide an oval-tracked exercise apparatus that ensures a reduction of the distance between both planks.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1:
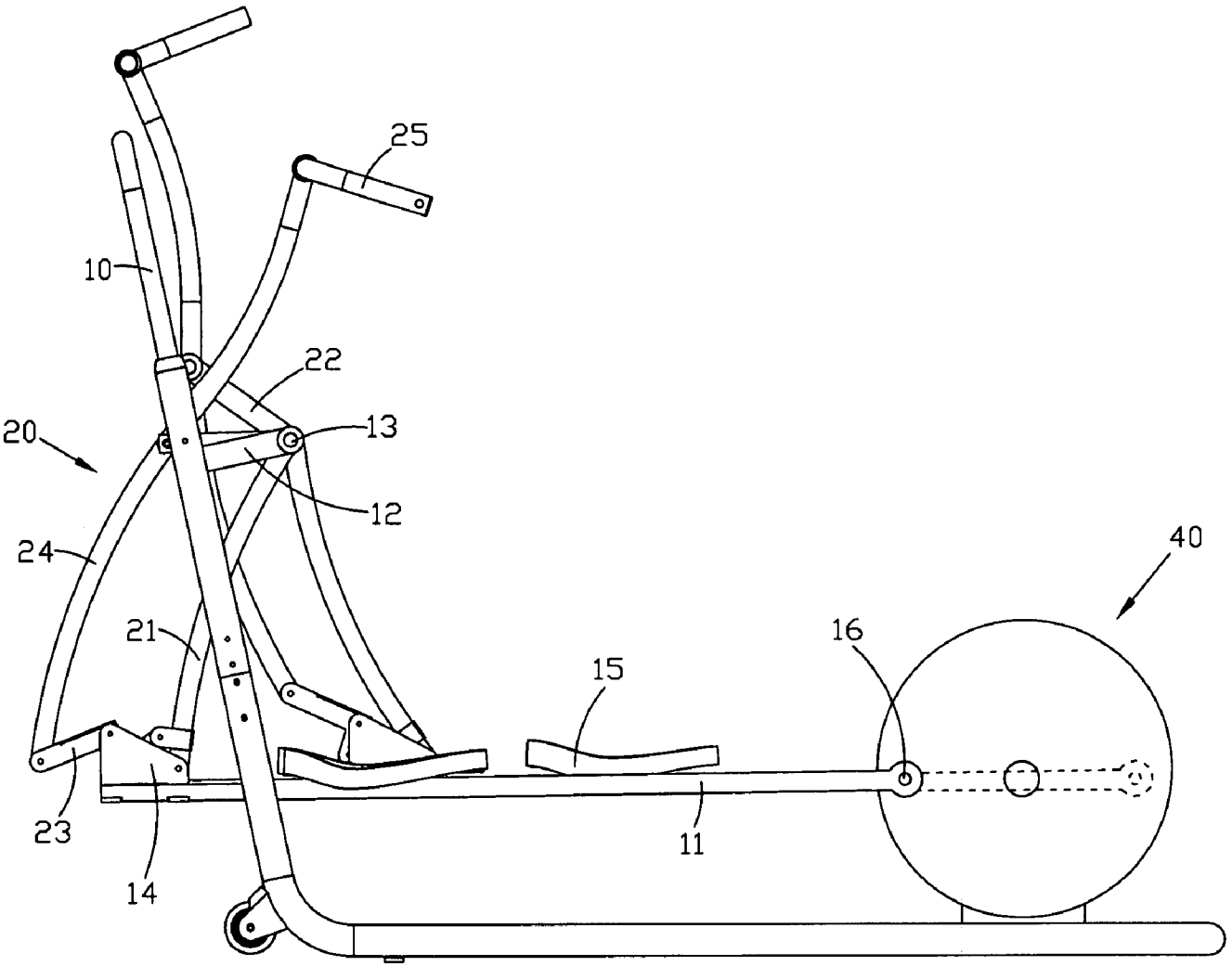
FIG. 1 is a side view of a first embodiment of an oval-tracked exercise apparatus of the invention.

Referring to FIG. 1, a main frame 10 of the present invention has a connecting arm 12 that creates a hinge joint with a transverse support 13. Two auxiliary rods 21 and two pivoting rods 22 are pivotally supported on the transverse support 13. Further, a bottom end of the auxiliary rods 21 is pivoted on a rear end of a connecting member 14 of a plank 11 while a coupled arm 23 is pivoted on a front end of the connecting member 14. Thereafter, a distal end of two swing rods 24 is coupled to another end of the coupled arm 23. A middle part of the swing rod 24 is rotatably supported on a free end of the pivoting rod 22. In this way, the auxiliary rods 21 and the swing rods 24 can be assembled to be a complete mechanical system 20.

A treadle 15 is fixed on each of the planks 11. Besides, the plank 11 includes a driving end 16 formed opposite to the connecting member 14. The driving ends 16 of both planks 11 are located on opposing sides of a phantom diameter of a resisting rotating mechanism 40. While an operator treads with his feet on both planks 11 in an alternating up-and-down motion, the resisting rotating mechanism 40 will be driven in rotation. Meanwhile, the connecting members 14 of both planks impart motion to the coupled arms 23 that then drives the swing rods 24 to move in an alternating succession. Accordingly, the mechanical system 20 is brought into a synchronic alternating swing motion within an area enclosed by a radius of the length of the pivoting rods 22 around a center of the transverse support 13. Thus, the operator can hold both handles 25 on the top of the swing rods 24 to simulate climbing action. Since the treadles 15 on the planks 11 restricted by the resisting rotating mechanism 40 moves in an oval track, the exercise apparatus is called "oval-tracked exercise apparatus".

The exercise apparatus includes a hinge joint of the transverse support 13 of the main frame 10 with the mechanical system 20 and a hinge joint of the planks 11 with the resisting rotating mechanism 40. As the connecting arms 12 between the transverse support 13 and the main frame 10 are rigidly affixed, the exercise apparatus is therefore named a stationary type exercise apparatus. The exercise apparatus shown in FIGS. 2 through 5 is an adjustable type exercise apparatus.

Therefore, the advantages of the aforementioned stationary type exercise apparatus can be concluded as follows:

1. The use of the aforementioned stationary type exercise apparatus can simulate the climbing action of the hands, unlike that the conventional rocker arms can only perform single arched swing action. Therefore, it fulfills the demand on ergonomic effects.
2. The simulation of the movement of both hands of the operator during exercise session enables the respective feet to synchronically move in an oval track for keeping the operator's health in good condition.

Another oval-tracked exercise apparatus, as shown in FIGS. 2 through 5, is a adjustable type exercise apparatus. Similarly, a connecting arm 12 is provided for connecting with a transverse support 13. The transverse support 13 creates a hinge joint with auxiliary rods 21 and pivoting rods 22 of a mechanical system 20. A bottom end of either auxiliary rod 21 is pivoted on one end of a connecting member 14 of a plank 11 while a coupled arm 23 is pivotally connected to the opposing end of the connecting member 14. The other end of the coupled arm 23 created a hinge joint with a distal end of each of two swing rods 24. The swing rods 24 move in an alternating succession by a hinge joint with a free end of the pivoting rods 22. Each of the planks 11 has a driving end 16 opposite to the connecting member 14 which is rotatably supported on a crank 41.

The embodiment shown in FIGS. 2 through 5 has the substantially same configuration as the embodiment shown in FIG. 1; however, the difference lies in that a supporting seat 31 is provided on the main frame 10 for creating a hinge joint with the connecting arm 12. Accordingly, the mechanical system 20 is produced by the hinge joint of the transverse support 13 with the connecting arm 12 and by the hinge joint of the transverse support 13 with the auxiliary rods 21 and the swing rods 24. In this way, the mechanical system 20 can be brought into a synchronic alternating swing motion within an area enclosed by a radius of the length of the connecting arm 12 around a center of the supporting seat 31.

The movable feature of the transverse support 13 is created by a push rod 32 with one of its ends pivotally connected to the transverse support 13 and with its opposing end connected to a motor 33, thereby forming an adjusting assembly 30 for adjusting the height of the transverse support 13.

Meanwhile, the invention has the same components that are correspondingly disposed at opposing sides. In order to facilitate the illustration of the mechanical relationship among the mechanical system, the planks 11, and the resisting rotating mechanism 40 and to prevent unnecessary confusion, they are shown and described with only one side thereof.

Figure 2:
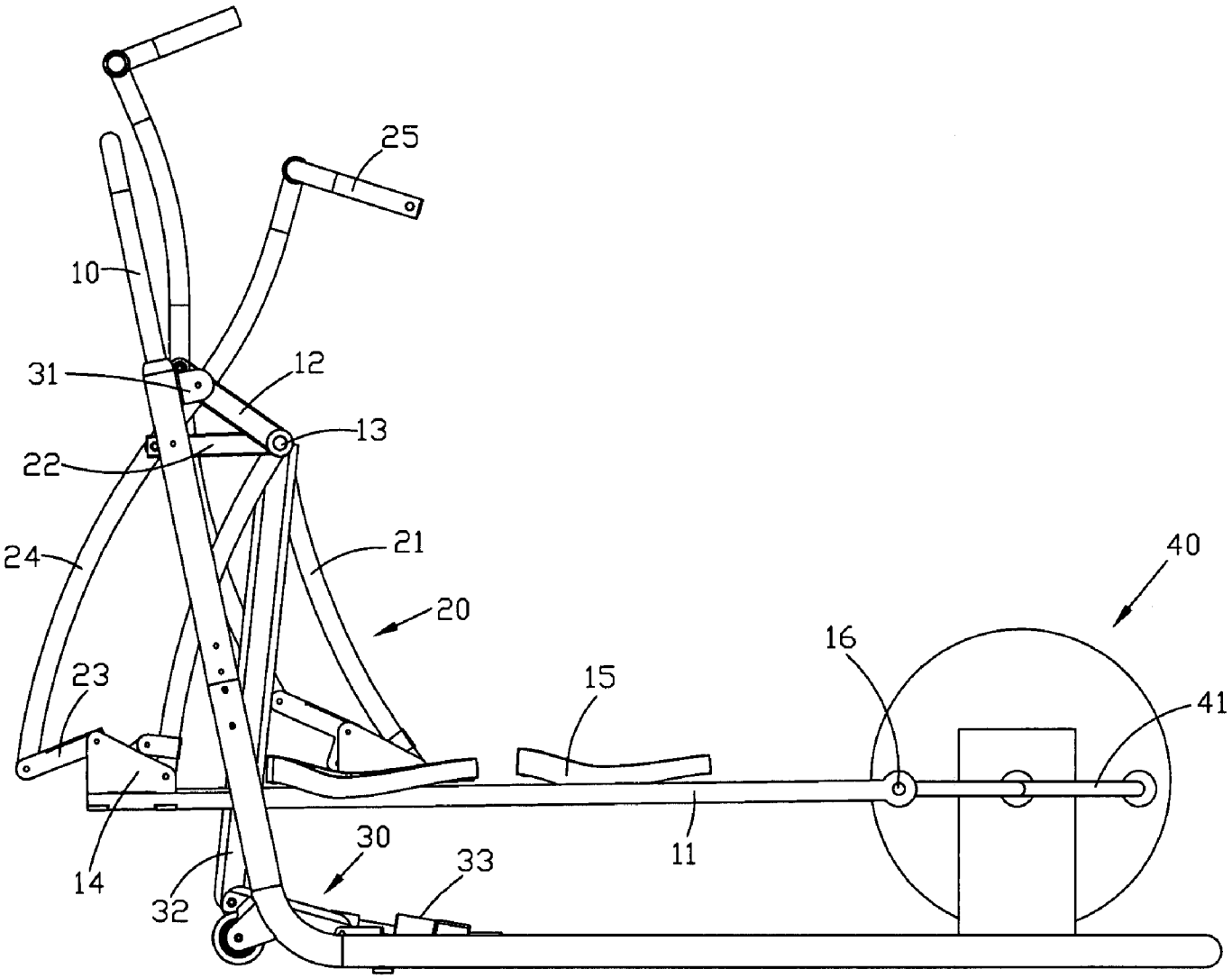
FIG. 2 is a side view of a second embodiment of the oval-tracked exercise apparatus of the invention.

First of all, the driving end 16 of the plank 11, as shown in FIG. 2, is located at a starting point on a left side of the crank 41 of the resisting rotating mechanism 40. Then, the transverse support 13 is adjusted by the adjusting assembly 30 to a certain height. The plank 11 is in an unmoved and hanged state due to the connection of the connecting member 14 with the mechanical system 20. At that time, the auxiliary rod 21 is movably coupled to the connecting member 14 of the plank 11 such that a distal end of the swing rods 24 is moved to the leftmost point in place under restriction of the pivoting rod 22. Meanwhile, the handle 25 on the top of the swing rods 24 is moved to the right side. Thus, we know that the handle 25 moves in an direction opposite to the direction in which the distal end of the swing rod 24 or the driving end 16 moves.

Figure 3:
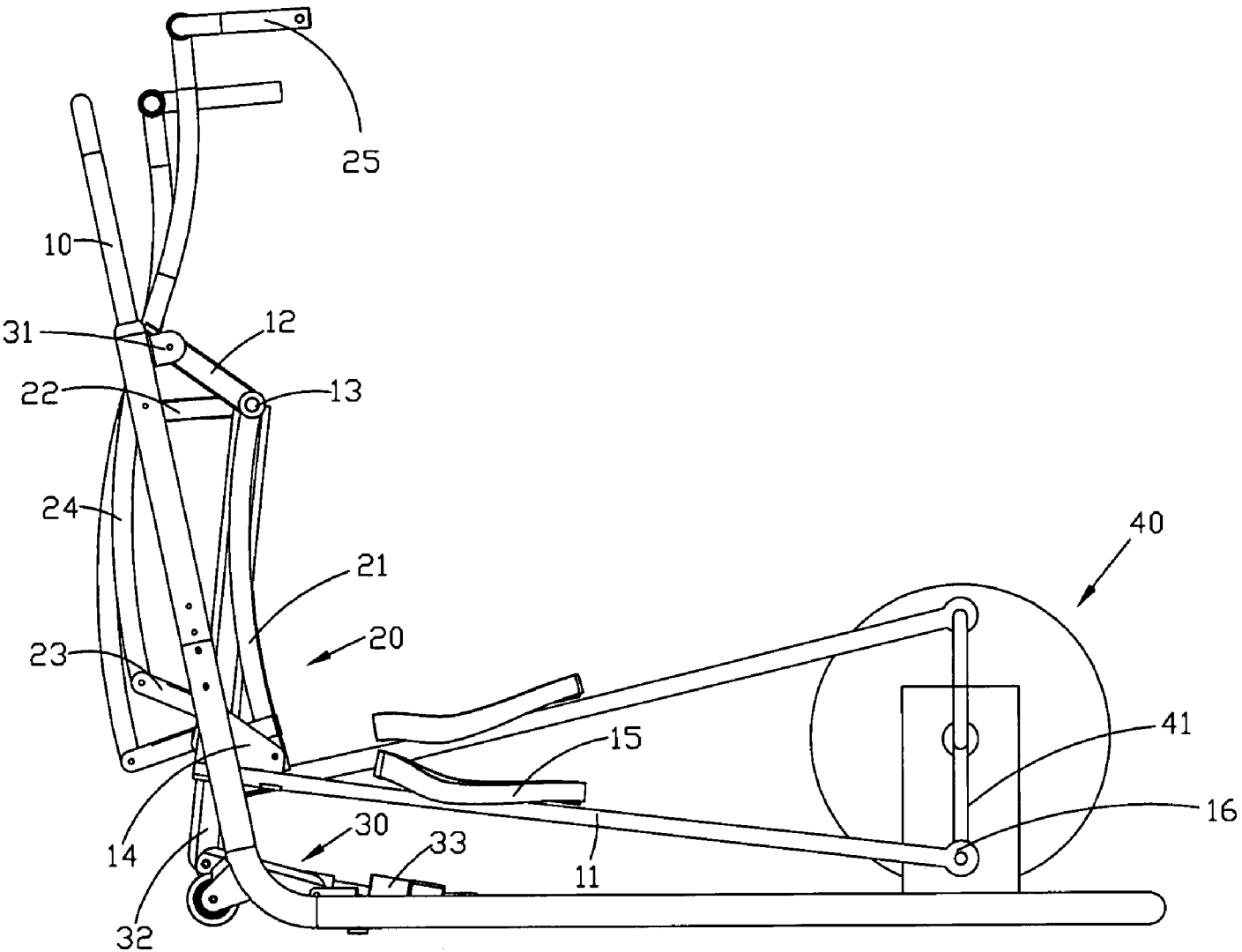
FIG. 3 is a side view of FIG. 2 with a driving end situated at the lowest end of a resisting rotating mechanism.

When the driving end 16 of the plank 11 is brought by the treading force of the operator or by an electric motor to a bottom end of the resisting rotating mechanism 40 shown in FIG. 3, the movement of the mechanical system 20 causes the movement of the handle 25 to a topmost point of the whole oval track.

Figure 4:
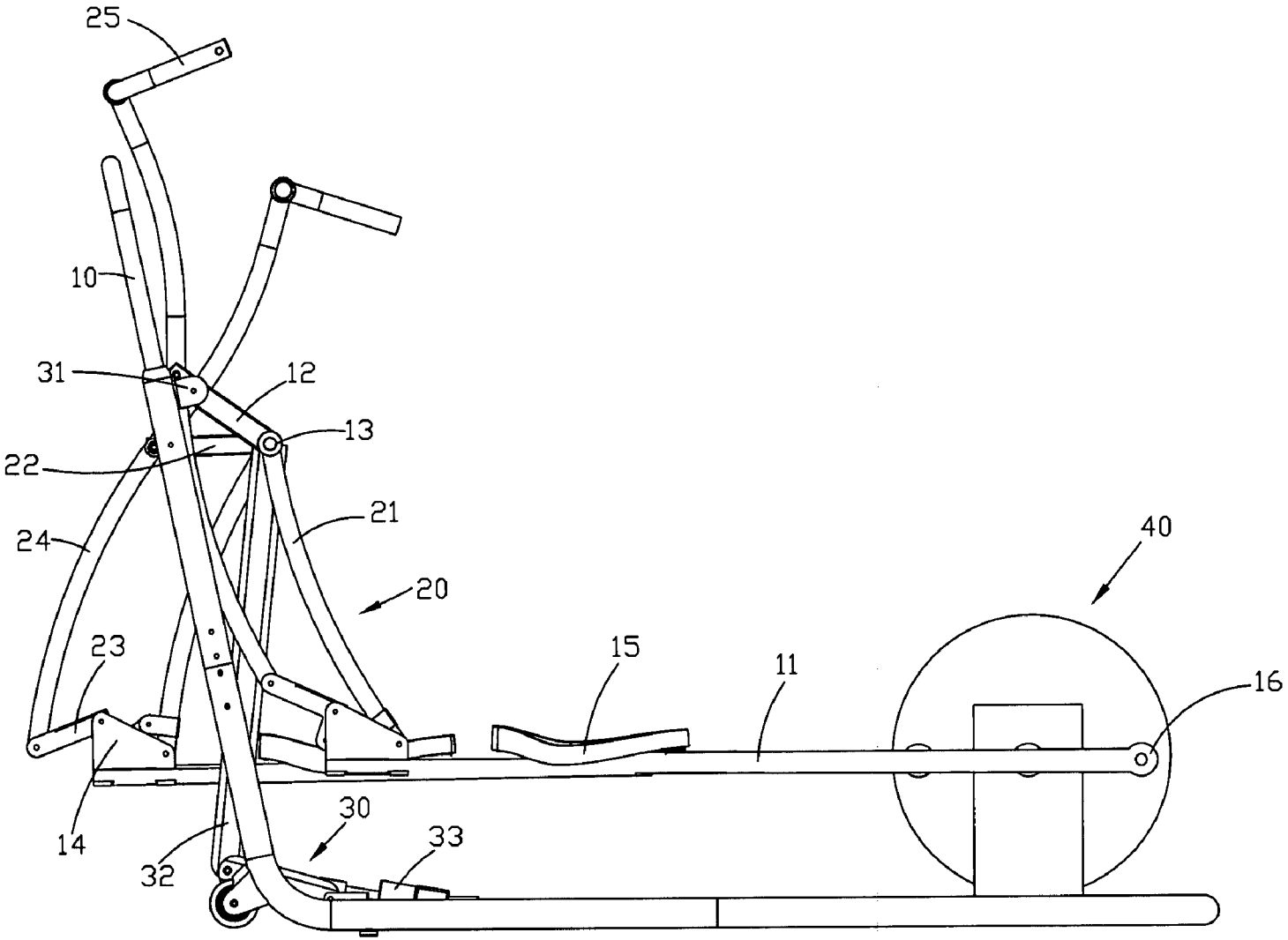
FIG. 4 is a side view of FIG. 2 with a driving end situated at the rightmost end of the resisting rotating mechanism.
Figure 5:
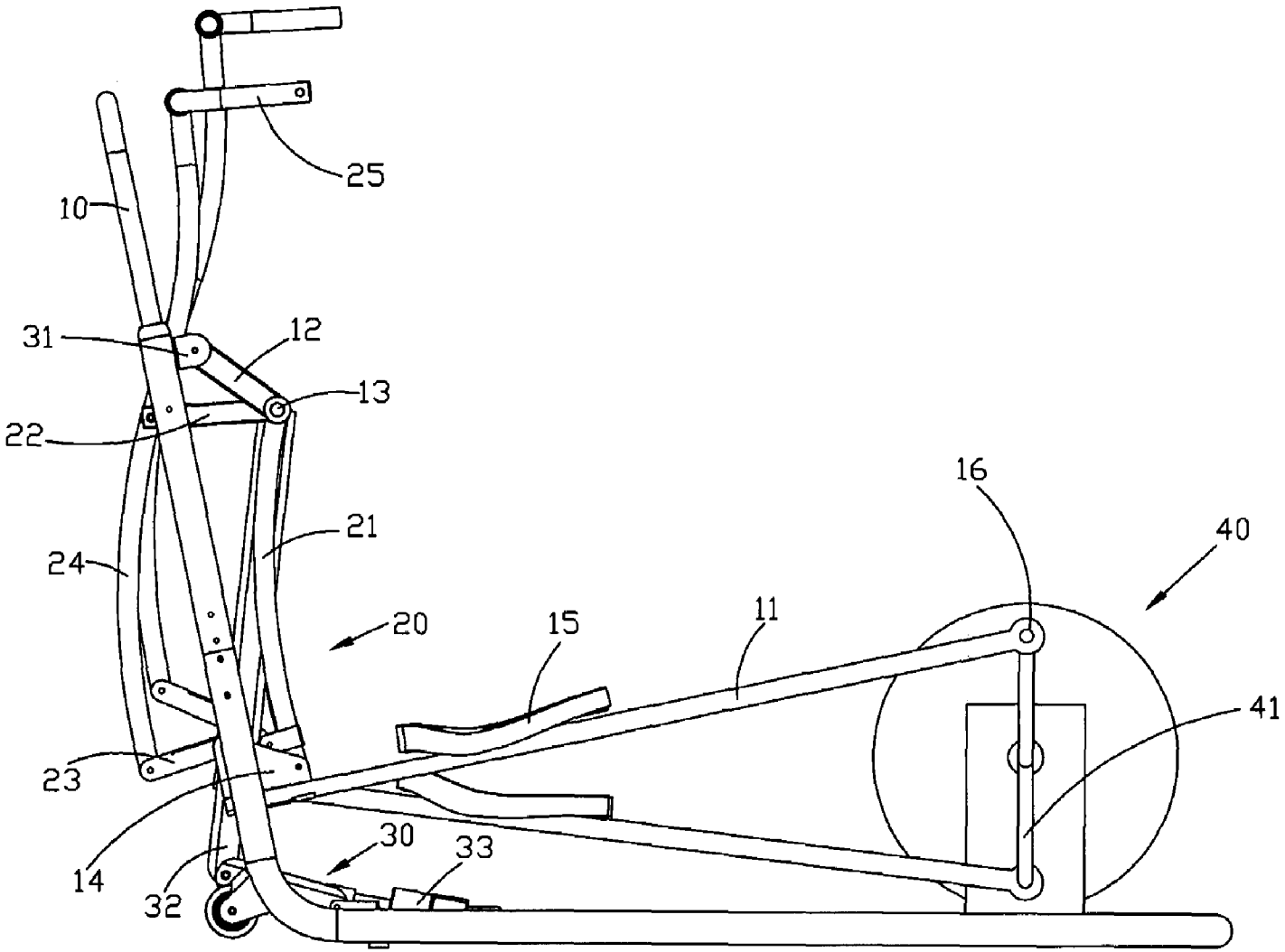
FIG. 5 is a side view of FIG. 2 with a driving end situated at the topmost end of the resisting rotating mechanism.

As shown in FIG. 4, the driving end 16 of the plank 11 is driven to the rightmost side of the resisting rotating mechanism 40, and the handle 25 is brought by the mechanical system 20 to the leftmost side of the whole oval track. While the driving end 16 of the plank 11, as shown in FIG. 5, is driven to the topmost end of the resisting rotating mechanism 40, the handle 25 is brought by the mechanical system 20 to the lowest position of the whole oval track. Due to the above-mentioned reciprocating motion, both hands and feet of the operator can simulated the climbing and treading motion, respectively, thereby achieving an ergonomic effect during the exercise sessions.

In addition to achieving the effects of the stationary type exercise apparatus, the adjustable type exercise apparatus can employ the motor 33 of the adjusting assembly 30 to extend or retract the push rod 32 for changing the movement position of the treadle 15.

When the push rod 32 is extended by the motor 33, the transverse support 13 is upwardly moved counterclockwise under restriction of the connecting arm 12. Meanwhile, the plank 11 can be raised since the auxiliary rod 21 is coupled with the connecting member 14 on the plank 11. When the push rod 32 is retracted by the motor 33, the transverse support 13 is downwardly moved clockwise. Accordingly, the connecting member 14 on the plank 11 is lowered. In this way, movement on a uphill, a downhill, or a flat surface can be simulated.

Figure 6:
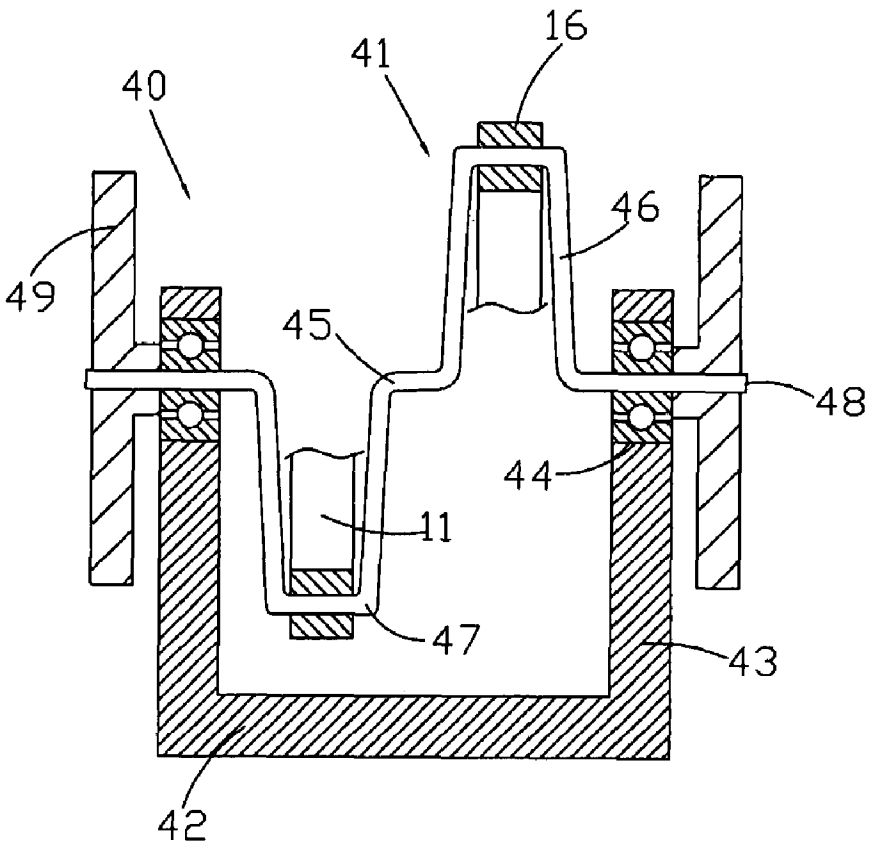
FIG. 6 is a cutaway view of the resisting rotating mechanism.
Figure 7:
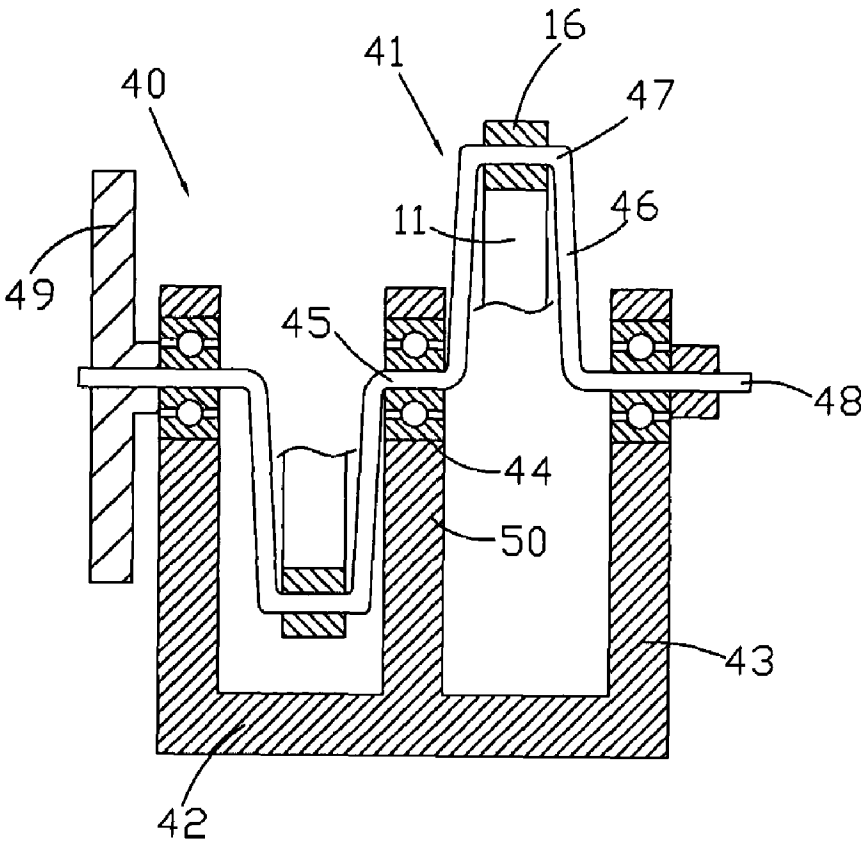
FIG. 7 is a cutaway view of another embodiment of the resisting rotating mechanism.

As shown in FIGS. 6 and 7, the resisting rotating mechanism 40 adapted for the stationary and adjusting type exercise apparatus in accordance with the invention and rotatably connected with the driving end 16 of the plank 11 is a flywheel, a belt wheel, a resistance mechanism, etc. The resisting rotating mechanism 40 includes a base 42 from both sides of which a side wall 43 is upwardly extended, respectively. Two opposing holes 44 are provided for insertion of a respective bearing. The crank 41 has a central part 45 for dividing the crank 41 into two corresponding crank subsections. Each crank subsection includes a yoke 46 having a pivoting part 47 on which the driving end 16 of the plank 11 is rotatably mounted. Both distal ends of the crank 41 is respectively formed with a connecting member 48 that is inserted through the respective bearing and rotatably received therein.

Based upon the above-mentioned structure, both planks 11 are spaced apart by the length of the central part 45 so that it's not necessary for the operator to extend his feet as widely as the shoulder. Accordingly, the walking position can be considerably improved.

In order to make the use of the crank 41 more stable, the base 42, as shown in FIG. 7, further includes a middle wall 50 similarly having a hole 44 for insertion of a bearing on which the central part 45 of the crank 41 is rotatably supported.

Furthermore, a flywheel, a belt wheel or a resisting apparatus can be fitted to both sides of the base 42, as shown in FIG. 6. Alternatively, it can be fitted to only one side thereof, as shown in FIG. 7 while a motor adapted to control rotational speed by an electrical gauge is connected to the other side of the base 42.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. An oval-tracked exercise apparatus comprising:

a) a main frame having:

i) two planks, each of the two planks has a connecting member located on a first plank end and a driving end located on a second plank end thereof;

ii) two connecting arms, each of the two connecting arms has a first connecting arm end connected to the main frame; and iii) transverse support;

b) a mechanical system having:

i) two auxiliary rods, each of the two auxiliary rods has a first auxiliary rod end pivotally connected to the connecting member of one of the two planks;

ii) two swing rods;

iii) two pivoting rods, each of the two pivoting rods has a first pivoting rod end pivotally connected to a middle portion of one of the two swing rods;

iv) two coupled arms, each of the two coupled arms is pivotally connected at a first coupled arm end to the connecting member of one of the two planks and is connected at a second coupled arm end to a first swing rod end of one of the two swing rods; and v) two handles, one of the two handles is connected to a second swing rod end of each of the two swing rods; and c) a resisting rotating mechanism, the driving end of each of the two planks is pivotally connected to opposing sides of the resisting rotating mechanism, wherein each of the two connecting arms has a second connecting arm end pivotally connected to each of a second pivoting rod end of one of the two pivoting rods and a second auxiliary rod end of one of the two auxiliary rods by the transverse support.

2. The oval-tracked exercise apparatus according to claim 1, further comprising an adjusting assembly having:

a) two supporting seats connected to the main frame, the first connecting arm end of each of the two connecting arms is pivotally connected to one of the two supporting seats;

b) a push rod having a first end connected to the transverse support;

c) an electric motor connected to a second end of the push rod and selectively adjusting a height of the transverse support; and d) a driving member driven by the motor and located between the push rod and the motor.

3. The oval-tracked exercise apparatus according to claim 1, wherein the resisting rotating mechanism has:

a) a base having two side walls extending upwardly from opposing sides thereof, each of the two side walls has a through hole;

b) two bearings, one of the two bearing is inserted into the though hole of each of the two side walls; and c) a crank having two crank subsections and a central part located between the two crank subsections, each of the two crank subsections has a connecting member and a yoke with a pivoting part, the driving end of each of the two planks is rotatably connected to the pivoting part of one of the two crank subsections, the connecting member of each of the two crank subsections is inserted through one of the two bearings, wherein the two planks are spaced apart a distance corresponding to a length of the central part.

4. The oval-tracked exercise apparatus according to claim 3, wherein the resisting rotating mechanism includes:

a) a middle wall located between the two side walls and having a central hole; and b) a middle bearing inserted into the central hole, the central part of the crank is inserted into the bearing.

* * * * *